United States Patent [19]

Nishida et al.

[11] 3,966,865

[45] June 29, 1976

[54] METHOD FOR PRODUCING FIBRIL FIBROUS STRUCTURES

[75] Inventors: Takeshi Nishida, Kobe; Isao Shiromaru, Nagahama; Tsutomu Teshima, Osaka, all of Japan

[73] Assignee: Kanebo, Ltd., Tokyo, Japan

[22] Filed: Apr. 22, 1974

[21] Appl. No.: 462,950

[30] Foreign Application Priority Data

Apr. 21, 1973 Japan ..... 48-45628

[52] U.S. Cl. ..... 264/147; 264/171; 264/DIG. 47

[51] Int. Cl.[2] ..... B29H 7/18

[58] Field of Search ..... 264/171, 147, 157, DIG. 47

[56] References Cited

UNITED STATES PATENTS

| | | | |
|---|---|---|---|
| 3,117,906 | 1/1964 | Tanner | 264/171 |
| 3,264,390 | 8/1966 | Tanner | 264/171 |
| 3,350,488 | 10/1967 | Breen | 264/171 |
| 3,353,345 | 11/1967 | Setzer | 264/171 |
| 3,418,200 | 12/1968 | Tanner | 264/171 |
| 3,432,898 | 3/1969 | Stanley et al. | 28/72 |
| 3,452,130 | 6/1969 | Petzl | 264/171 |
| 3,814,561 | 6/1974 | Matsui et al. | 264/171 |

FOREIGN PATENTS OR APPLICATIONS

| | | | |
|---|---|---|---|
| 45-6299 | 3/1970 | Japan | 264/171 |
| 1,069,696 | 5/1967 | United Kingdom | 264/210 F |

*Primary Examiner*—Jay H. Woo

*Attorney, Agent, or Firm*—Woodhams, Blanchard and Flynn

[57] ABSTRACT

Synthetic fibrous structures having a soft feel, an excellent luster and a silky feel are produced by forming composite filaments composed of a polyamide and a component having poor affinity to the polyamide selected from the group consisting of a polyester, polyolefin and polyacrylonitrile into a fibrous structure and treating the fibrous structure with an aqueous emulsion of 1.5–50% by weight of at least one of benzyl alcohol and phenylethyl alcohol and having a percent transmittancy of less than 20%, which is obtained by adding a surfactant to the emulsion, whereby to fibrillate the composite filaments.

13 Claims, 11 Drawing Figures

METHOD FOR PRODUCING FIBRIL FIBROUS STRUCTURES

The present invention relates to a method for producing synthetic fibrous structures having a high quality and particularly to a method for producing fibrous structures having a soft feel and an excellent luster and composed of fibrillated fibers of polyamide and polyester, polyolefin or polyacrylonitrile.

Conventional synthetic fibers, or example, fibrous structures composed of polyesters or polyamides, are simple in the size and cross-sectional shape of the monofilaments and consequently their feel and luster are more simple and cool than natural fibers and the quality of fibrous structures made therefrom has been lower.

Recently, in order to ameliorate these defects, crimping, mix knitting, mix weaving, formation of composite filaments and the like have been attempted but satisfactory fibrous structures have not been obtained and the practice of such methods on an industrial scale has been difficult.

Among them, the relatively preferably procedures are as follows. Composite filaments are prepared wherein a plurality of components having poor mutual affinity are bonded along the longitudinal direction of the unitary filament, and after or prior to knitting or weaving, are separated into individual components (fibrillate) or one component is selectively dissolved or decomposed so that the other component remains in the form of filaments having sharp edges, whereby a silky feel is provided to the knitted goods or woven fabrics. For example, U.S. Pat. No. 3,350,488 discloses such an embodiment. However, this method has the following problems and it has been difficult to practice this method on an industrial scale.

1. When the previously fibrillated fibers are knitted or woven, the monofilaments are fine, so that troubles, for example, yarn breakage and the like, often occur in the fibrillating step and the preparing step for knitting and weaving.
2. When the fibrillating step is performed after knitting or weaving, the process for dissolving one component is very complicated and further the weight is decreased and the cost becomes high. Further recently environmental pollution has become an important problem and a large cost is incurred for making the treated solution harmless.

On the other hand, it is an excellent process to fibrillate composite filaments, which have been knitted or woven into a fabric, into a plurality of components without dissolving and removing one component, but the filaments after knitting or weaving are strongly fixed by the fabric texture and therefore it is difficult to fibrillate the filaments by a mechanical bending or impact or a chemical treatment and it is difficult to practice this method on an industrial scale.

The inventors have diligently studied for solving the above described drawbacks and accomplished the present invention.

An object of the present invention is to provide synthetic fibrous structures having a soft feel and a good luster.

Another object of the present invention is to provide a method for producing fibrillated fibrous structures on an industrial scale.

The present invention consists in a method for producing fibrillated fibrous structures in which fibrillatable composite filaments composed of a polyamide and a polyester, polyolefin or polyacrylonitrile are formed into a fibrous structure and then the fibrous structure is treated with an aqueous emulsion containing 1.5-50% by weight of at least one of benzyl alcohol and phenylethyl alcohol and having a percent transmittancy of less than 20%, to fibrillate the composite filaments.

The term "fibrillatable composite filaments composed of a polyamide and a polyester, polyolefin or polyacrylonitrile" used herein means the composite filaments wherein the polyamide and the polyester, polyolefin or polyacrylonitrile, each of which has poor affinity to the polyamide, are bonded along the longitudinal direction of the unitary filament in such a form that one component is not completely surrounded by the other component in the cross-section and the practical configurations are the side-by-side repeating composite filament as shown in FIG. 1 and the radially bonded composite filaments as shown in FIGS. 2–6. The composite filaments as shown in FIGS. 3–6 are preferable.

The polymers having poor affinity to polyamide include polyester, polyolefin and polyacrylonitrile. The polyester and polyolefin are preferred in view of the ease of conjugate spinning thereof with polyamide by means of melt spinning. Further the polyolefin has a poor dyeability, so that the polyester is most preferable. The combination of polyamide with polyester is the most preferable in view of the feel and luster of the resulting fibrillated fibrous structure.

As polyamides, mention may be made of nylon 4, nylon 6, nylon 7, nylon 11, nylon 12, nylon 66, nylon 610, poly-m-xylylene adipamide, poly-p-xylylene decaneamide, poly-bis-cyclohexylmethane decaneamide and the copolyamides thereof.

As the polyesters, mention may be made of polyethylene terephthalate, polytetramethylene terephthalate, polyethylene oxybenzoate, poly-1,4-dimethylcyclohexane terephthalate, polypivalolactone and the copolyesters thereof. As polyolefins, mention may be made of polyethylene, polypropylene and the copolyolefins thereof.

The term "an aqueous emulsion" used herein means an emulsion of benzyl alcohol and/or phenylethyl alcohol in water formed by adding a surfactant.

As the surfactants, provided that they can emulsify benzyl alcohol and/or phenylethyl alcohol so as to make the percent transmittancy of the emulsion to be less than 20%, any one of nonionic surfactants, cationic surfactants, anionic surfactants, amphoteric surfactants and mixtures thereof may be used.

For example, as the nonionic surfactants, mention may be made of polyethylene glycol type surfactants, such as higher alcohol ethylene oxide adducts, alkylphenol ethylene oxide adducts, fatty acid ethylene oxide adducts and fat oil-ethylene oxide adducts and polyhydric alcohol type surfactants, such as fatty acid esters of glycerol, fatty acid esters of pentaerythritol, fatty acid esters of sorbitol and sorbitan.

As cationic surfactants, mention may be made of amine salt type surfactants, such as higher alkylamine salts, higher alkylamine ethylene oxide adducts, salts of lower amines and higher fatty acids and quaternary ammonium salt type surfactants, such as alkyl trimethyl ammonium salt, alkyl dimethyl benzyl ammonium salt, tertiary amine obtained by condensing N,N'-diethylethylenediamine with a fatty acid, which is converted into a quaternary ammonium salt by an alkyl group.

As anionic surfactants, mention may be made of soaps and sulfuric acid ester salts, such as higher alcohol sulfuric acid ester (sodium) salt, higher alkyl ether sulfuric acid ester (sodium) salt, sulfonated oil, and sulfonated fatty acid ester, sulfonate salts, such as alkylbenzene sulfonic acid sodium salt, aerosol OT type of sulfosuccinic acid diester, phosphoric acid salts and the like.

Amphoteric surfactants include amino acid type and betain type.

The amount of the surfactants added is 5-20% by weight, particularly 10% based on the alcohols.

The percent transmittancy according to the present invention was determined under the following conditions by using a photoelectric colorimeter.

| | |
|---|---|
| Cell: | 10 mm (5 c.c.) |
| Control liquid: | Distilled water |
| Light source: | Tungsten lamp |
| Wave length: | 495 mμ. |

The term "treatment with an aqueous emulsion" used herein means that the sample to be treated is immersed in the aqueous emulsion. The immersion treatment includes permitting the sample to stand after the excess liquid is squeezed and removed (padding process). The immersion treatment may be effected at room temperature or by heating. When the fibrillatable composite filaments in the fibrous structure as mentioned above are to be fibrillated by means of the aqueous emulsion of the alcohol into two components, the following processes may be effected. In general, when benzyl alcohol or phenylethyl alcohol is in a low concentration (usually less than 5%), it is preferable to heat the sample after immersing. That is, the sample is immersed in the aqueous emulsion at a temperature of lower than 40°C and then the temperature is raised to higher than 70°C in more than 10 minutes and the temperature is kept for more than 10 minutes. When the concentration is high (usually more than 8%), the padding process is preferable. In this case, the sample is permitted to stand at room temperature for more than 20 minutes or the sample is heated after padding.

The method of the present invention is characterized in that an aqueous emulsion containing 1.5–50% of benzyl alcohol and/or phenylethyl alcohol (abridged as "alcohol" hereinafter) and having a percent transmittancy of less than 20% is used. The reason why the fibrillatable composite filaments composed of a polyamide and a polyester, polyolefin or polyacrylonitrile can be fibrillated by treating with the alcohol, is presumably based on the following fact. The polyamide is swelled and shrunk by said alcohol but the other polymer conjugate spun therewith is not swelled and shrunk. The alcohol alone or an aqueous solution of the alcohol (when the concentration is very low, the aqueous solution can be formed) is very low in the fibrillating ability and particularly when the fibrillating composite filaments are knitted or woven and fixed by the texture, the fibrillating ability is not substantially developed. However, when the aqueous emulsion of the alcohol obtained by adding the surfactant is used, the fibrillating ability becomes very high.

The reason why the aqueous emulsion of the alcohol has the high fibrillating ability, is not clear but the inventors have found that in the fibrillation of the fibrillatable composite filaments containing polyamide, the ability when water and the alcohol concurrently act, is somewhat higher than the treatment with only the alcohol. It is considered that the reason will be based on the fact that in the case of the aqueous emulsion of the alcohol, the function of the alcohol to the fibrous structure is effected at a higher concentration of the alcohol in the presence of water. That is, when an aqueous emulsion having a percent transmittancy of less than 20% is used and the emulsion particles contact the fibrous structure, the alcohol contacts the fibrous structure in a higher concentration than when a homogeneous aqueous solution of the alcohol is used.

Even if some surfactants show a percent transmittancy of more than 20% at room temperature, there is the case where the emulsion considerably proceeds by heating (so called, cloud point), and in such a case, if the percent transmittancy is less than 20%, such a case is included within the scope of the present invention.

As the alcohol to be used, benzyl alcohol is more preferable, because said alcohol is higher in the fibrillating ability and less expensive than phenylethyl alcohol. The concentration of the alcohol in the emulsion must be not less than 1.5% for attaining the object of the present invention and when the concentration exceeds 50%, the emulsion becomes unstable, so that the concentration must be not more than 50%. The preferable concentration is 2.5–20% and the emulsion becomes fully stable and the handling is easy.

The method for producing the fibrillated fibrous structures according to the present invention was illustrated but it is surprising that the aqueous emulsion of benzyl alcohol and/or phenylethyl alcohol develops the high activity for fibrillating the composite filaments according to the present invention. The advantage that the composite filaments can be fibrillated after the filaments are formed into the fibrous structure, has been already mentioned and the utility of the present invention will be apparent.

The present invention is useful for obtaining excellent fibrous structures by applying to the knitted goods, woven fabrics, non-woven fabrics and the like but the more preferable results can be obtained by taking the following points into consideration.

For carrying out the present invention on the knitted or woven fabrics, it is preferable to effect the fibrillating treatment so as to satisfy the following conditions. The knitted or woven fabrics are fibrillated and shrunk so that the area shrinking percent (S) is 10–60%, preferably 15–40% and the thickness increasing percent (D) is more than 20% and a ratio of thickness increasing percent/area shrinking percent is more than 2, preferably more than 2.5.

The area shrinking percent is determined as follows.

Area prior to the fibrillating treatment: $A_0$

Area after the treatment: $A_1$

Area shrinking percent (%) $= A_0 - A_1 / A_0 \times 100(\%)$

The thickness increasing percent is determined as follows.

Thickness prior to the fibrillating treatment: $T_0$

Thickness after the treatment: $T_1$

Thickness increasing percent(%) $= T_1 - T_0 / I_0 \times 100(\%)$

The ratio of D/S being more than 2 means that the increase of the thickness based on the area shrinkage is large and by effecting the fibrillating treatment so as to satisfy these conditions, the knitted or woven fabrics are rich in the volume feel and have softness and an excellent luster and are very silky.

When the knitted or woven fabrics composed of the fibrillated fibers are shrunk with a heat treatment, two kinds of fibrils concurrently shrink and the difference of shrinkage becomes small and even if the knitted or woven fabrics are soft, the volume feel is poor and only a paper-like texture which is apt to form creases, is obtained.

However, in the present invention, since the fibrillating is effected by using an aqueous emulsion of the alcohol having the ability for swelling and shrinking polyamide, only the fibrils composed of polyamide considerably shrink and the shrinkage of the fibrils composed of the other component is restrained and it is easy to control the shrinkage so as to satisfy the above described conditions.

As the condition under which the fibrillation is effected so as to satisfy the above described conditions, the following two processes are usually adopted. One of them comprises effecting the fibrillating treatment with the alcohol having a relatively high concentration (usually more than 7%) at a temperature of lower than 60°C, preferably lower than 50°C. Under such a condition, the treating temperature is low, but the concentration of the alcohol in the treating liquid is high, so that the polyamide component fully swells and shrinks, while the component other than the polyamide component does not shrink too much, accordingly, the conditions are fully satisfied. The other process comprises immersing the fabric to be treated in an aqueous emulsion of the alcohol having a relatively low concentration (usually less than 7%) at a temperature of lower than 50°C and raising the temperature to higher than 80°C in more than 10 minutes. In this case, the concentration of the alcohol in the treating liquid is low but the fabric is heated, so that the polyamide component fully swells and shrinks, but the component other than polyamide shrinks while the shrinkage being set gradually from a low temperature, so that this component does not shrink too much and the shrinkage difference of the polyamide fibrils and the other component fibrils becomes large.

However, it is not preferable that the fabrics are directly immersed in the aqeuous emulsion at a temperature of higher than 80°C, because simultaneously with the fibrillation both the components are readily shrunk.

The ratio and configuration of the polyamide in the fibrillatable composite filaments are important. Because, if the amount of the polyamide component (highly shrinking component) is too large, the feel of the resulting fibrous structures become coarse and hard and if said amount is too small, a satisfactory shrinkage cannot be caused in the fibrous structures. Concerning the configuration, a configuration by which the component having a lower shrinkability is apt to be floated through the shrinkage, is preferable.

From the above described points, the ratio (area) of the polyamide in the cross-section of the fibrillating composite filaments is preferred to be 10–35%, more particularly 15–30%. The conjugating configuration is preferred to be as shown in FIGS. 3–7 and it is optimum that the polyamide is arranged so as to form at least three radial branches having uniform thin layers. The term "uniform thin layers" used herein means that the unevenness of the thickness in the branches is within ±25%. When the method of the present invention is carried out on a non-woven fabric, particularly a non-woven fabric obtained by needle punching the webs formed by a card cross layer system or a random webber system, if the non-woven fabric is shrunk in the volume to 10–40%, preferably 20–40%, the non-woven fabric becomes dense and at the same time flexible and such a fabric is preferable for the fibrous substrate of artificial leather.

Furthermore, in the practice of the present invention, the fibrillating is promoted by previously applying 0.5–10% by weight of polyvinyl alcohol, polyethylene glycol, water soluble acrylic polymer or a surfactant as a fibrillating assistant on the fibrous structure. The reason cannot be distinctly clarified but it is assumed that since these compounds have a high affinity to water and the alcohol, these compounds adsorb alcohol and promote the function of the alcohol to the fibrous structure.

The present invention develops the utility for the production of the fibril filaments. As mentioned above, the stable production of the fibril filaments in an industrial scale is very difficult but the production of fibril filaments becomes easy by knitting the fibrillatable composite filaments, effecting the fibrillating treatment of the present invention and unknitting the fabric. Upon the unknitting, the fibril filaments are apt to cause yard breakage but this can be prevented by previously twisting the fibrillatable composite filaments prior to the knitting. The twist number is 50–500 T/m, preferably 100–300 T/m. When the twist number is less than 50 T/m, the effect for preventing the yarn breakage is low, while when the twist number exceeds the above described range, it is difficult to cause the fibrillating.

The present invention will be explained in more detail.

For a better understanding of the invention, reference is taken to the accompanying drawings, wherein.

The following examples are given for the purpose of illustration of this invention and are not intended as limitations thereof.

EXAMPLE 1

Figure 1:
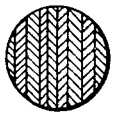
FIGS. 1 to 6 are the cross-sectional views of the fibrillatable composite filaments according to the present invention.
Figure 2:
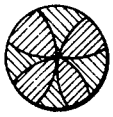
Figure 3:
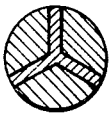
Figure 4:
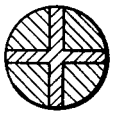
Figure 5:
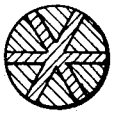
Figure 6:
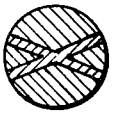
Figure 7:
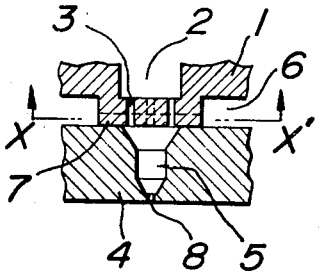
FIG. 7 is a cross-sectional view of a spinneret for producing a typical fibrillatable composite filament of the present invention.
Figure 8:
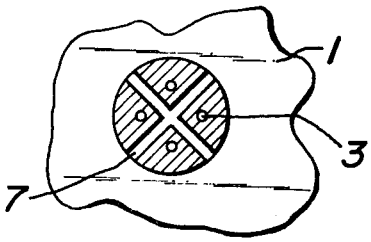
FIG. 8 is a cross-sectional view of the spinneret shown in FIG. 7 taken along the arrow line XX'.

Nylon 66 having a relative viscosity of 38.8 (formic acid solution of 8.4%, 30°C) and polyethylene terephthalate (abbreviated as "PET") having an intrinsic viscosity of 0.68 (in o-chlorophenol, 30°C) were melt conjugate spun in a conjugate ratio of 1:3 (volume) and wound up at a rate of 700 m/min to obtain the undrawn fibrillating composite filaments having the same cross-section as shown in FIG. 4. In this composite filament, nylon 66 constitutes the cross portion. FIGS. 7 and 8 are enlarged views of the bonding portion of two components and the extrusion orifice in the spinneret used for the conjugate spinning of the above described composite filament and FIG. 7 is a cross-sectional view of the spinneret and FIG. 8 is a cross-sectional view of the spinneret shown in FIG. 7 taken along the arrow line XX'. Namely, the melted PET was flowed into a conduit 5 in the outer spinneret plate 4 through four small holes 3 from a conduit 2 in the inner spinneret plate 1.

On the other hand, the melted nylon 66 was flowed into the conduit 5 in the outer spinneret 4 through channels 7 from a reservoir 6 formed by the inner spinneret plate 1 and the outer spinneret plate 4 and divided PET into four parts and was bonded with PET and nylon 66 and PET were extruded through an orifice 8 to form the composite filament having the cross-section as shown in FIG. 4.

The thus obtained undrawn filaments were drawn to 4.02 times their original length by using hot rollers heated at 85°C and contacted with a plate at 150°C to set the drawn filaments, whereby the fibrillatable composite filaments of 50d/14f were obtained.

The composite filaments were applied to a twist of 250 T/m and then woven into a twill *Habutae*. In the density on the fabric, the warp was 159.5 f/inch and the weft was 116 f/inch.

The obtained grey fabrics were treated with the treating liquids having the composition and the percent transmittancy as shown in the following Table 1. The treatment was effected at a liquor ratio of 1:50 and the grey fabrics were immersed in the treating liquid at 30°C and the temperature was raised to 80°C in 30 minutes and the grey fabrics were immersed for 30 minutes by keeping the temperature.

Table 1

| Treating liquid No. | Benzyl alcohol concentration (%) | Surfactant No. | Surfactant Kind | Surfactant Concentration (%) | Percent transmittancy (%) |
|---|---|---|---|---|---|
| 1 | 3 | not added | — | — | 95 |
| 2 | " | 1 | Anionic | 0.5 | 2 |
| 3 | " | 2 | Nonionic | 0.5 | 3 |
| 4 | " | 3 | Anionic | 0.5 | 50 |
| 5 | " | 4 | Anionic | 0.5 | 30 |

Note: Surfactant
No. 1: Sumorl BK-concentration, made by Nikka Chemical Industry Co. main ingredient: polyethylene glycol alkyl ether sulfonic acid sodium salt.
No. 2: Scourol 900, made by Kaoatlas Co. main ingredient: polyoxyethylene nonylphenyl ether.
No. 3: Spark, made by Lion Oil Fat Co. main ingredient: straight chain alkylbenzene sulfonate.
No. 4: Emal NC, made by Kaoatlas Co. main ingredient: polyoxyethylene alkylphenyl ether sulfonic acid sodium salt.

After the treated fabrics were thoroughly washed with water and dried, said fabrics were determined with respect to the fibrillation degree of the filaments in the fabrics, area shrinking percent (S), thickness increasing percent (D) and D/S value. The obtained results are shown in the following Table 2 and it can be seen from treating liquid Nos. 2 and 3 according to the present invention that the good results can be obtained.

The measurement of the fibrillation degree was effected as follows. The center portion of the sample fabric was cut off with scissors and the filaments were taken out and embedded with paraffin and cut into a thin layer, which was observed by an optical microscope and the degree of separation into two components was determined and classified into the following ranks.

Rank A: The separation is more than 90%.
Rank B: The separation is 70–80%.
Rank C: The separation is 50–70%.
Rank D: The separation is less than 50%.

The measurement of the thickness was effected by using a thickness meter which was adjusted so that a load of 100 g/cm$^2$ is applied on a disc of a diameter of 10 mm.

Table 2

| Sample No. | Treating liquid No. | Fibrillation degree | Feeling and appearance | S (%) | D (%) | D/S |
|---|---|---|---|---|---|---|
| 1 | 1 | D | Paper-like, coarse and hard | — | — | — |
| 2 | 2 | A | Very soft, bulky, very silky | 26 | 77 | 3 |
| 3 | 3 | A | Very soft, bulky, very silky | 28 | 70 | 2.5 |
| 4 | 4 | D | Paper-like, coarse and hard | — | — | — |
| 5 | 5 | D | Paper-like, coarse and hard | — | — | — |

EXAMPLE 2

The twill *Habutae* composed of the fibrillatable composite filaments in Example 1 was treated with the treating liquid having the composition as shown in the following Table 3.

The treatment was effected in the same manner as described in Example 1. However, the temperature was raised to 60°C. The obtained results are shown in the following Table 4. From this Table, it can be seen that Sample Nos. 7, 8, 9, 11, 12 and 13, which are within the scope of the present invention, provide excellent results. However, in the case of treating liquid No. 14, the aqueous emulsion was unstable and the treatment was not effected.

Table 3

| Treating liquid No. | Benzyl alcohol concentration (%) | Surfactant No. | Surfactant Concentration (%) | Percent transmittancy (%) |
|---|---|---|---|---|
| 6 | 1 | 1 | 0.3 | 4 |
| 7 | 1.5 | 1 | " | 4 |
| 8 | 3 | 1 | " | 2 |
| 9 | " | 1 | 0.1 | 20 |
| 10 | " | 1 | 0.05 | 30 |
| 11 | 15 | 1 | 1.5 | 0 |
| 12 | 30 | 1 | 3 | 0 |
| 13 | 50 | 1 | 5 | 0 |
| 14 | 60 | 1 | 6 | Emulsion is unstable |

Note:
Surfactant No. 1: Sumorl BK-concentration.

Table 4

| Sample No. | Treating liquid No. | Fibrillation degree | Feeling and appearance | S (%) | D (%) | D/S |
|---|---|---|---|---|---|---|
| 6 | 6 | C | Paper-like, fairly coarse and hard | — | — | — |
| 7 | 7 | B | Soft, bulky, silky | 15 | 31 | 2.1 |
| 8 | 8 | A | Very soft, bulky, very silky | 23 | 77 | 3.3 |
| 9 | 9 | B | Soft, bulky, silky | 12 | 28 | 2.3 |
| 10 | 10 | C | Paper-like, fairly coarse and hard | — | — | — |
| 11 | 11 | A | Very soft, bulky | 32 | 109 | 3.4 |
| 12 | 12 | A | Soft, bulky, silky | 44 | 181 | 4.1 |

Table 4-continued

| Sample No. | Treating liquid No. | Fibrillation degree | Feeling and appearance | S (%) | D (%) | D/S |
|---|---|---|---|---|---|---|
| 13 | 13 | A | Somewhat hard, bulky, silky | 57 | 320 | 5.6 |

EXAMPLE 3

Nylon 6 having an intrinsic viscosity of 1.15 (in m-cresol, 30°C) and PET having an intrinsic viscosity of 0.63 (in o-chlorophenol, 30°C) were conjugate spun and drawn in substantially the same manner as described in Example 1 to obtain the fibrillating composite filaments of 50d/14f, which were woven into a twill *Habutae*.

The resulting fabric was immersed in an aqueous emulsion containing 15% of benzyl alcohol and 1.5% of Sumorl BK-concentration and having a percent transmittancy of 0% and the immersed fabric was squeezed so that the liquid retaining percent was 100% and then the fabric was left to stand at room temperature for 2 hours and then washed with water and dried. The resulting fabric (Sample No. 14) was determined with respect to the fibrillation degree, the feel, S, D and D/S. The fibrillation degree was A and the feel and appearance were bulky and silky. S was 19%, D was 72% and D/S was 3.7.

EXAMPLE 4

The twill *Habutae* in Example 3 was immersed in an aqueous emulsion (40°C, liquor ratio of 1:30) containing 7% of β-phenylethyl alcohol and 1% of Scourol 900 and having a percent transmittancy of 1%. After the immersion, the temperature was raised to 90°C in 30 minutes and the immersion was continued at this temperature for 30 minutes and the immersed fabric was washed with water and then dried. The thus obtained fabric (Sample No. 15) was measured. The fibrillation degree was A and the feel and appearance were soft, bulky and silky, S was 32%, D was 181% and D/S was 5.7.

EXAMPLE 5

The twill *Habutae* in Example 3 was subjected to the fibrillating treatment as shown in the following Table 5 and then washed with water and dried to obtain the fabrics of Sample Nos. 16–19. The feeling and the like were determined to obtain the results as shown in the following Table 6.

Table 5

| Sample No. | Treating liquid No. | Treating process |
|---|---|---|
| 16 | 8 | The fabric was immersed at room temperature and left to stand for 24 hours. |
| 17 | 8 | Immersed at 80°C, left to stand for 30 minutes. |
| 18 | 11 | Immersed in the treating liquid kept at 80°C for 2 minutes. |
| 19 | 11 | Immersed at 30°C, the temperature was raised to 90°C in 30 minutes and the immersion was continued at the temperature for 10 minutes. |

Table 6

| Sample No. | Fibrillation degree | Feeling and appearance | S (%) | D (%) | D/S |
|---|---|---|---|---|---|
| 16 | B | Soft but somewhat flat and silky. | 10 | 13 | 1.3 |
| 17 | B | Soft but somewhat flat and silky. | 15 | 24 | 1.6 |
| 18 | A | Fairly hard, bulky, silky | 62 | 210 | 3.4 |
| 19 | A | Somewhat hard, silky, fibrils too float, apt to be caught by hand. | 52 | 370 | 7.1 |

EXAMPLE 6

Samples extracted from Examples 2, 3, 4 and 5 were measured with respect to wrinkle recovery and bending resistance and the results are shown in the following Table 7. From Table 7, it can be seen that the fabrics become very soft through the fabrillation of the present invention and when the area shrinking percent (S) is 10–60%, the thickness increasing percent (D) is more than 20% and D/S is more than 2, the crease proofing property is improved.

Furthermore, the measurement of the wrinkle recovery was followed to Monsanto process in JIS-L-1079-1966 and the larger the numeral value, the better the crease proofing property is.

The measurement of the bending resistance was followed to Clark process in JIS-L-1079-1966 and the smaller the value, the more flexible the fabric is. Both the values are average values of measured values in the warp direction and the weft direction.

Figure 9:
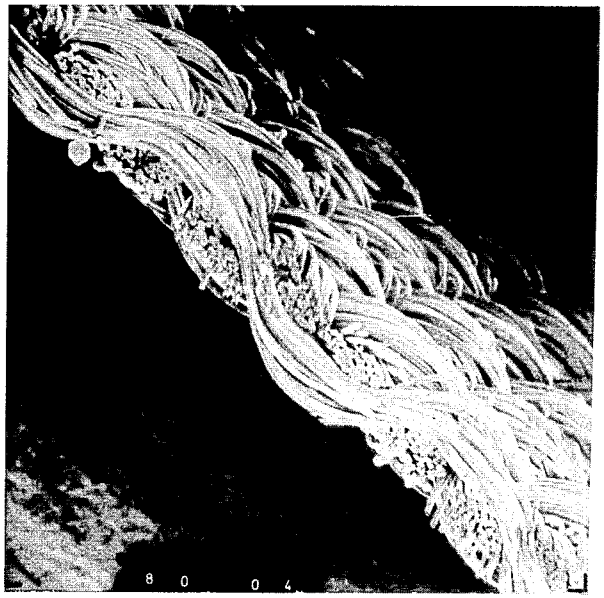
FIGS. 9, 10 and 11 are perspective enlarged photographs obtained by using a scanning type electron microscope with respect to a twill *Habutae* obtained by the method of the present invention, a silk twill *Habutae* and a polyester twill *Habutae* respectively.
Figure 10:
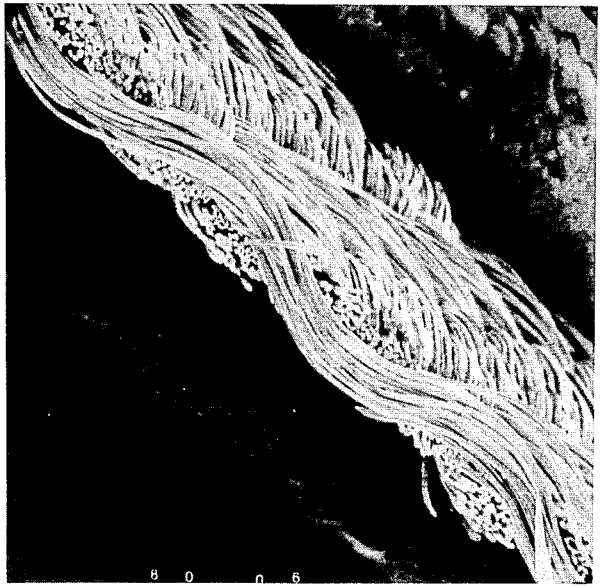
Figure 11:
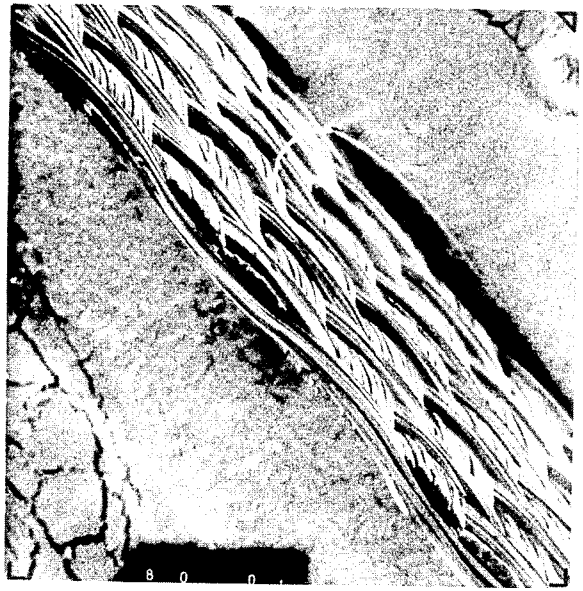

Table 7 includes the measured values of silk twill *Habutae* and polyester twill *Habutae* (silk-like finishing was effected by the processing for decreasing the weight with an alkali). FIG. 9 is a perspective enlarged photograph of the cross-section of the fabric of Sample 8 according to the present invention by means of a scanning type of electron microscope and FIGS. 10 and 11 are the same photographs of the silk twill Habutae and polyester twill Habutae respectively. It can be seen that the cross-sectional configuration of the fabric of the present invention is more similar to the silk fabric than the polyester fabric.

Table 7

| Sample No. | | Fibrillation degree | S (%) | D (%) | D/S | Wrinkle recovery (%) | Bending resistance (mm) |
|---|---|---|---|---|---|---|---|
| 1 | Not present invention | D | — | — | — | 52 | 58 |
| 6 | " | C | — | — | — | 57 | 56 |
| | Present | | | | | | |

Table 7-continued

| Sample No. | | Fibrillation degree | S (%) | D (%) | D/S | Wrinkle recovery (%) | Bending resistance (mm) |
|---|---|---|---|---|---|---|---|
| 16 | invention | B | 10 | 13 | 1.3 | 67 | 41 |
| 7 | " | B | 15 | 31 | 2.1 | 78 | 43 |
| 8 | " | A | 23 | 77 | 3.3 | 88 | 47 |
| 14 | " | A | 19 | 72 | 3.7 | 87 | 45 |
| 13 | " | A | 57 | 320 | 5.6 | 91 | 55 |
| Silk | — | — | — | — | — | 65 | 45 |
| Polyester | — | — | — | — | — | 82 | 44 |

EXAMPLE 7

The fibrillating composite filaments of 75d/14f were obtained in substantially the same manner as described in Example 1.

The composite filaments were applied to a twist of 150 T/m and the twisted filaments were woven into a satin. In the density of the fabric, the warp was 158 f/inch and the weft was 99 f/inch. The resulting grey fabric was subjected to the fibrillating treatment under the same condition as in Example 3 and then washed with water and dried to obtain a satin fabric (Sample No. 20). S was 21%, D was 69% and D/S was 3.3 and the fabric was soft and very bulky and had silky appearance and feeling.

EXAMPLE 8

In substantially the same manner as described in Example 3, the fibrillating composite filaments of 75d/14f and 50d/28f having the cross-section as shown in FIG. 4 were produced from nylon 6 and PET.

Table 8

| Sample No. | Filament | Fibrillating treatment | Volume shrinking percent (%) | Thickness (mm) | Density (g/cm³) | Tensile strength (Kg/cm²) | Softness (g.cm) | Appearance |
|---|---|---|---|---|---|---|---|---|
| 21 | 75d/14f | Not carry out | 0 | 1.80 | 0.164 | 10.2 | 0.628 | Coarse |
| 22 | " | A | 6.5 | 1.70 | 0.173 | 8.5 | 0.222 | Fairly dense |
| 23 | " | B | 11.4 | 1.63 | 0.185 | 13.6 | 0.235 | Dense, uniform |
| 24 | " | C | 20.1 | 1.50 | 0.203 | 15.3 | 0.240 | Very dense, uniform |
| 25 | 50d/28f | C | 22.5 | 1.47 | 0.210 | 17.2 | 0.173 | " |
| 26 | Polyester | | 12.3 (heating shrinkage) | 1.62 | 0.185 | 15.6 | 0.688 | Coarse |

Each of the above two kinds of filaments was cut to 50 mm and the cut filaments were formed into a web by means of a random webber and the resulting web was subjected to needle punching by means of needles having a count of No. 40 so that the needle penetration density becomes 3,000/cm² to form a three dimensionally extangled non-woven fabric having a weight of 300 g/cm². Then, the non-woven fabric was subjected to the fibrillating treatment in the following three manners and washed thoroughly with water and dried. The resulting non-woven fabrics were measured with respect to the physical properties. The results are shown in the following Table 8. The physical properties of the non-woven fabric obtained from polyester filaments of 25d/24f in the same manner as described above are also shown in the following Table 8.

The non-woven fabric obtained by the method of the present invention is excellent in the softness and particularly when the volume shrinkage is made to be more than 10%, both the tensile strength and the softness are excellent.

Fibrillating treatment:

Process A: The sample was immersed in an emulsion containing 3% of benzyl alcohol and 0.3% of a nonionic surfactant and having a percent transmittancy of 3% and a temperature of 40°C and the temperature was raised to 80°C in 30 minutes and the treatment was continued at 80°C for 30 minutes.

Process B: The concentrations of benzyl alcohol and the surfactant in Process A were varied to 7% and 0.7% respectively. The percent transmittancy of this emulsion was 0%.

Process C: The concentration of benzyl alcohol and the surfactant in Process A were varied to 15% and 1.5% respectively. The percent transmittancy of this emulsion was 0%.

The softness was measured by Cantilever process in JIS-L-1005 and the smaller the value, the softer the web is.

EXAMPLE 9

The non-woven fabric of Sample No. 25 was impregnated with a dimethyl formamide solution of 20% of polyurethane and the polyurethane was applied in a squeeze percent of 250%. Then the non-woven fabric was immersed in water to coagulate the polyurethane and then washed and dried. The amount of polyurethane applied on the non-woven fabric was 50 based on 100 of the fibers. Then, the resulting sheet was sliced and the surface was polished with an emergy paper and then dyed. The thus obtained sheet was provided with flock on the whole surface and covered with very fine fibers and was a natural suedelike product having a high quality and a softness.

EXAMPLE 10

The grey fabric of the twill Habutae in Example 1 was impregnated with the fibrillating assistants as shown in the following Table 9 and dried and then the grey fabric was subjected to the fabrillating treatment by using the treating liquid No. 7 in Example 2 and then thoroughly washed with water and dried. The fibrillation degree was determined. The results are shown in the following Table 10. From the results in Table 10, it can be seen that the effect for the fibrillating treatment is improved as compared with the Sample No. 7 in Table 4.

Table 9

| Sample No. | Fibrillating assistant | Applied amount (%) |
|---|---|---|
| 27 | Polyvinyl alcohol (polymerization degree 1,700 completely saponification) | 3 |
| 28 | Polyethylene glycol (molecular weight 400) | 2 |
| 29 | Water soluble acrylic copolymer | 3 |
| 30 | Anionic surfactant | 2 |

Table 10

| Sample No. | Fibrillation degree | Feeling and appearance | S (%) | D (%) | D/S |
|---|---|---|---|---|---|
| 27 | A | Very soft, bulky, silky | 21 | 78 | 3.5 |
| 28 | A | " | 20 | 65 | 3.3 |
| 29 | A | " | 24 | 82 | 3.4 |
| 30 | A | " | 22 | 72 | 3.3 |

EXAMPLE 11

The fibrillatable composite filaments of 50d/14f in Example 3 were subjected to a twist of 150 T/m and the twisted composite filaments were knitted into a tubular knitted fabric by means of a circular knitting machine having a diameter of needle cylinder of 3½ inches and 180 needles.

Said tubular fabric was subjected to the fibrillating treatment in the same manner as described in Example 3 and washed with water and dried and then the knitted fabric was unknitted by means of a cross winder to obtain fibril filaments. The resulting filaments were the fibril filaments having such a configuration that the polyamide fibrils shrink and the polyester fibrils float. Said fibril filaments were subjected to an additional twist of 150 T/m and then knitted by means of a tricot knitting machine into a tricot knit fabric. There were substantially no troubles in the additional twisting, warping and knitting steps and the operation was stable. The resulting knitted fabric had a silky appearance and feel and a very high quality.

EXAMPLE 12

Various fabrillatable composite filaments of 50d/14f were obtained by varying the conjugate ratio and the bonded configuration of nylon 6 and PET as shown in the following Table 11 in substantially the same manner as described in Example 3. The resulting composite filaments were woven into twill Habutaes and then subjected to the fibrillating treatment. The feel and appearance of the obtained fabrics are shown in the following Table 12.

It can be seen from Table 12 that the composite filaments, in which the conjugate ratio of nylon 6 is 35%, 25% and 10% and nylon 6 constitutes the radial portion in the cross-section, can provide the excellent silky fabric. Particularly, the composite filament having the conjugate ratio of nylon 6 being 25% and the same cross-section as described above is more preferable.

Table 11

| Filament No. | Conjugate ratio | | Cross-sectional view | |
|---|---|---|---|---|
| | Nylon 6 | PET | Nylon 6 | PET |
| 11 | 45 | 55 | Cross | Sector |
| 12 | 35 | 65 | " | " |
| 13 | 25 | 75 | " | " |
| 14 | 10 | 90 | " | " |
| 15 | 5 | 95 | " | " |
| 16 | 75 | 25 | Sector | Cross |

Table 12

| Sample No. | Filament No. | Fibrillation degree | Feeling and appearance | S (%) | D (%) | D/S | Wrinkle recovery (%) | Bending resistance (mm) |
|---|---|---|---|---|---|---|---|---|
| 31 | 11 | A | Somewhat hard, flat, silky | 27 | 54 | 2 | 71 | 59 |
| 32 | 12 | A | Soft, bulky, silky | 23 | 68 | 3 | 79 | 51 |
| 33 | 13 | A | Very soft, bulky, silky | 20 | 69 | 3.5 | 88 | 45 |
| 34 | 14 | A | Soft, bulky, silky | 17 | 73 | 4.3 | 83 | 44 |
| 35 | 15 | B | Soft, flat, silky | 9 | 22 | 2.4 | 69 | 44 |
| 36 | 16 | A | Fairly hard, flat, silky | 41 | 130 | 3.2 | 63 | 63 |

EXAMPLE 13

Nylon 6 having an intrinsic viscosity of 1.18 and polypropylene (made by Mitsubishi Yuka K.K. NOBLEN MA3A) were melt spun in a conjugate ratio of 1:3 by using the same spinneret as described in Example 1. The resulting undrawn composite filaments were drawn to 3.82 times their original length by means of a drawing pin at 65°C to obtain the fibrillating composite filaments of 50d/14f having the cross-section as shown in FIG. 4 and the composite filaments were woven into a twill Habutae.

The resulting Habutae was immersed in an aqueous emulsion containing 10% of benzyl alcohol and 1.0% of Sumorl BK-concentration and having a percent transmittancy of 0% and the aqueous emulsion was squeezed so that the emulsion retaining percent was 85% and the fabric was left to stand at room temperature for 2 hours and washed with water and dried. The resulting fabric (Sample No. 37) was measured. The fibrillation degree was A and the feel and appearance were very soft and bulky and silky. S was 17%, D was 53% and D/S was 3.1.

We claim:

1. A method for producing fibrillated fibrous structures which comprises forming into a knit fabric, or a woven fabric, or a non-woven fabric, fabrillatable composite filaments consisting essentially of (A) a polyamide and (B) a component having poor affinity to said polyamide and selected from the group consisting of a polyester, a polyolefin and polyacrylonitrile, each of said composite filaments in transverse cross-section consisting of at least three integral polyamide layers of substantially uniform thickness which comprise from 10 to 35 percent of the cross-sectional area of the filament and which diverge substantially radially in the outward direction and extend to the perimeter of the filament, said layers dividing said component B of said filament into at least three separate segments which extend to the perimeter of the filament; immersing said fabric in an aqueous emulsion consisting essentially of water, from 1.5 to 50 percent by weight of an alcohol selected from the group consisting of benzyl alcohol and phenylethyl alcohol, and a surfactant in an amount in the range of 5 to 20 percent by weight, based on the weight of said alcohol, and effective to impart to said emulsion a percent transmittancy of less than 20 percent; and maintaining said fabric in contact with said emulsion under conditions effective to swell and shrink component A and to minimize swelling and shrinking of component B for a period of time effective to separate at least about 70% of said segments of component B from said polyamide layers whereby to fibrillate the composite filaments to impart a soft silky feel and a bulky appearance to the fibrous structure, and in the case of knit and woven fabrics to shrink the arena of the fabric from 10 to 60 percent, to increase the thickness of the fabric more than 20 percent and wherein the ratio of said thickness increase percent to said area shrinkage percent is more than 2, and in the case of non-woven fabrics to shrink its volume from 10 to 40 percent.

2. The method as claimed in claim 1, wherein the fibrillatable composite filament is composed of a polyamide and a polyester.

3. The method as claimed in claim 1, wherein the amount of the alcohol in said emulsion is 2.5–20% by weight.

4. The method as claimed in claim 1, wherein an amount of the surfactant in said emulsion is 5–20% by weight based on the alcohol.

5. The method as claimed in claim 1, wherein said surfactant is a nonionic, cationic, anionic or amphoteric surfactant.

6. The method as claimed in claim 1, wherein said area ratio of the polyamide is 15–30%.

7. The method as claimed in claim 1, including the step of applying to the fabric composed of the fibrillatable composite filaments 0.5–10% by weight of a fibrillating assistant selected from the group consisting of polyvinyl alcohol, polyethylene glycol, a water soluble acrylic polymer and a surfactant, prior to immersing said fabric in said aqueous emulsion.

8. The method as claimed in claim 1, wherein the fibrillatable composite filaments are subjected to twisting to a twist number of 50–500 T/m prior to the knitting.

9. The method as claimed in claim 8, wherein said twist number is 100–300 T/m.

10. A method according to claim 1, in which the number of layers and the number of segments each is from 3 to 6.

11. A method according to claim 1 in which said aqueous emulsion contains from more than 7 to 20 percent by weight of said alcohol and the temperature of said emulsion is maintained at lower than 60°C during said immersing and maintaining steps.

12. A method according to claim 1 in which said emulsion contains from 1.5 to less than 7 percent by weight of said alcohol, the temperature of the emulsion is lower than 50°C when said fibrous structure is immersed therein, and during said maintaining step raising the temperature of the emulsion to more than 80°C and maintaining the emulsion of that temperature until fibrillation is completed.

13. A method for producing fibrillated filaments which comprises knitting into a knitted fabric fibrillatable composite filaments consisting essentially of (A) a polyamide and (B) a component having poor affinity to said polyamide and selected from the group consisting of a polyester, a polyolefin and polyacrylonitrile, each of said composite filaments in transverse cross-section consisting of at least three integral polyamide layers of substantially uniform thickness which comprise from 10 to 35 perccent of the cross-sectional area of the filament and which diverge substantially radially in the outward direction and extend to the perimeter of the filament, said layers dividing said component B of said filament into at least three separate segments which extend to the perimeter of the filament; immersing said knitted fabric in an aqueous emulsion consisting essentially of water, from 1.5 to 50 percent by weight of an alcohol selected from the group consisting of benzyl alcohol and phenylethyl alcohol, and a surfactant in an amount in the range of 5 to 20 percent by weight, based on the weight of said alcohol, and effective to impart to said emulsion a percent transmittancy of less than 20 percent, and maintaining said knitted fabric in contact with said emulsion under conditions effective to swell and shrink component A and to minimize swelling and shrinking of component B for a period of time effective to separate at least about 70% of said segments of component B from said polyamide layers whereby to fibrillate the composite filaments and to shrink the area of the fabric from 10 to 60 percent, to increase the thickness of the fabric more than 20 percent and wherein the ratio of said thickness increase percent to said area shrinkage percent is more than 2, and then unknitting the knitted fabric to obtain fibrillated filaments.

* * * * *

UNITED STATES PATENT AND TRADEMARK OFFICE

CERTIFICATE OF CORRECTION

PATENT NO. : 3 966 865

DATED : June 29, 1976

INVENTOR(S) : Takeshi Nishida, Isao Shiromaru & Tsutomu Teshima

It is certified that error appears in the above-identified patent and that said Letters Patent are hereby corrected as shown below:

Col. 15, line 48; change "arena" to ---area---.

Col. 16, line 10; change "Claim 1" to ---Claim 13---.

Signed and Sealed this

Fourth Day of January 1977

[SEAL]

*Attest:*

RUTH C. MASON
*Attesting Officer*

C. MARSHALL DANN
*Commissioner of Patents and Trademarks*